United States Patent [19]

Domroe et al.

[11] 4,141,100

[45] Feb. 27, 1979

[54] BINDING MACHINE AND COVER FOR USE THEREWITH

[76] Inventors: William E. Domroe, 2858 Shore Rd., Bellmore, N.Y. 11710; Thomas W. F. Lindquist, R.D. #3 - Deerfield Rd., Lake Katonah; Robert Stern, 16 Winthrop Rd., Port Washington, both of N.Y. 11050

[21] Appl. No.: 726,613

[22] Filed: Sep. 27, 1976

[51] Int. Cl.[2] ..... B42C 19/00

[52] U.S. Cl. ..... 11/1 AD; 281/21 R; 156/583

[58] Field of Search ..... 11/1 AD, 1 R; 156/583; 281/21

[56] References Cited

U.S. PATENT DOCUMENTS

| | | | |
|---|---|---|---|
| 3,292,951 | 12/1966 | Schoenberger | 11/1 R X |
| 3,717,366 | 2/1973 | Decker | 11/1 R X |
| 3,956,053 | 5/1976 | Staats | 11/1 AD X |
| 3,995,886 | 12/1976 | Staats | 11/1 AD X |
| 4,009,498 | 3/1977 | Staats | 11/1 AD |

*Primary Examiner*—Stephen C. Pellegrino
*Attorney, Agent, or Firm*—Gottlieb, Rackman & Reisman

[57] ABSTRACT

A machine for binding a plurality of loose sheets into bound pamphlet form is disclosed, together with a cover suitable to receive such sheets. The machine has a stationary base to which a main chassis is fixedly mounted. A movable carriage is mounted for slidable movement with respect to the chassis by means of rollers fixed to the carriage and which slide along the inner side edges of the upper plate of the chassis. When the carriage is in the open position, its upper rear wall is separated from the fixed rear wall of the base, thereby exposing an underlying heating channel and permitting the insertion therein of a cover containing pages to be bound thereto. The chassis is then moved to a relatively closed position, whereby its rear wall approaches the corresponding rear wall of the base, retaining the cover and its contained pages therebetween. A brief heating cycle, utilizing a printed circuit board in the heating channel, then causes the pages to adhere to a pre-glued strip along the inner spine of the cover, which has become somewhat viscous during the heating cycle. The cover is then removed and following a short cooling period, the bound pamphlet is completed.

In one embodiment of the cover to be used with this invention, thin flexible strips running parallel to the spine of the cover are affixed to the inner surfaces of the front and rear cover portions to provide sufficient rigidity to retain the pages in a firm binding position in the cover when the carriage is moved to its closed position and the heating cycle is initiated. Other embodiments of the cover provide for adhering different binding members to the cover member to provide binding versatility.

27 Claims, 22 Drawing Figures

36A
36A'
36J
36
42E
42F
42
42E1
36C
36D
36H
36G
42D1
36B
42B
42D
34C
36E1
36E
34
34E
36E2
36F
42C
34B
34D
42A
34C
34E
34A
30
32E
32B
32D
32
32B
32C
32F
32A

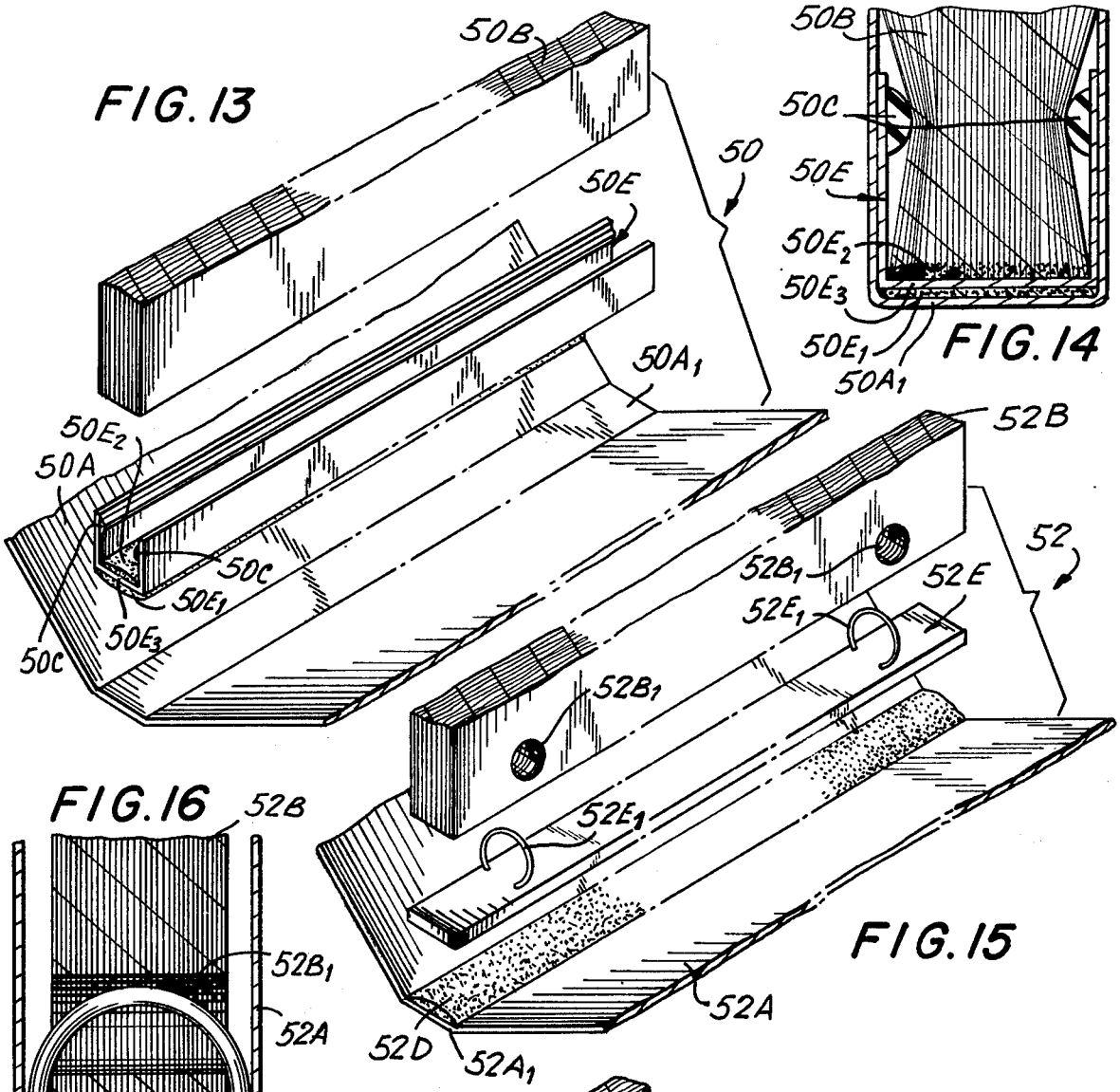
FIG. 14
FIG. 15
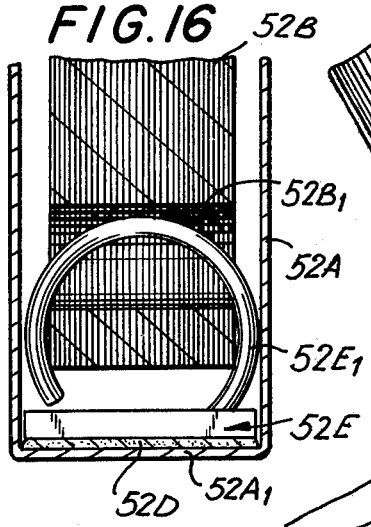
FIG. 16
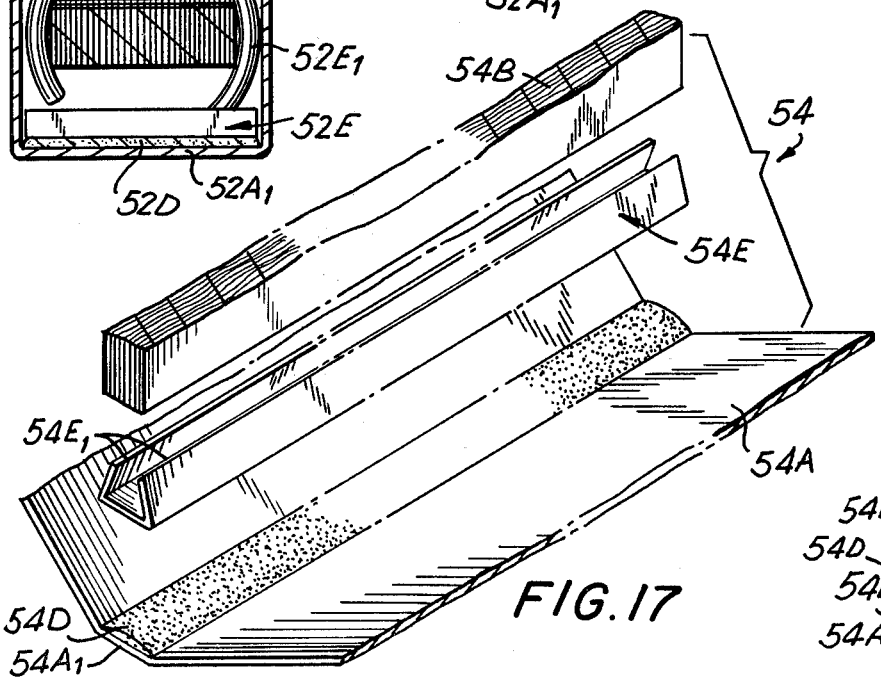
FIG. 17
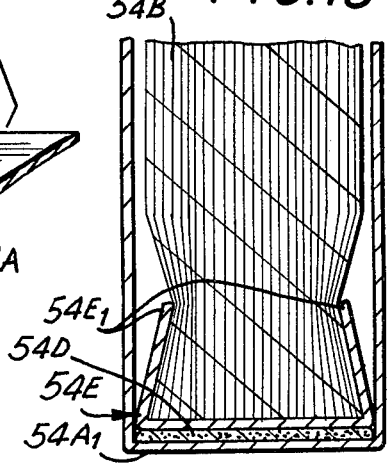
FIG. 18

BINDING MACHINE AND COVER FOR USE THEREWITH

This invention relates to binding machines and covers with use therewith, and in particular, to equipment for preparing bound reports, memoranda, and the like within a cover, by means of a brief heating cycle which permits pages to be retained by an adhesive previously affixed to the cover.

In recent years, a sustantial increase in the need for disseminating written and printed material has occurred. This increase has been partly attributable to the "information explosion", whereby great quantities of data, facts and other materials have to be placed into the hands of everincreasing numbers of people. Thus, the field of education has sought to offer many research tools which may not always be available in conventional printed books — this has required that less formal publications be prepared and distributed to students aand teachers. The same is true for reports and other similar documents which are prepared during a couse of study, such as essays, book reviews and dissertations. Students often spend a considerable amount of time in preparing these reports, and they are frequently typed and reproduced in professional fashion, but are ultimately presented for evaluation in a rather plain and unimpressive form, with little or no resemblance to a genuine scholarly work, which they often are in actuality.

In industry and the professions, this same type of presentation of information and documents is also occurring. Business people are often called upon to present their opinions, test results and reports to customers and clients who are paying substantial sums for these services. While the content of the reports is presumably significant and valuable, the visual impression of the reports usually does not compare with the level of material within them. Typical examples of the need for professional presentation of documents include engineering firms, advertising agencies, lawyers and accountants, to name just a few. Without exception, such businesses will take great pains to compile their data and opinions quite carefully, will have it typed or printed in a most professional manner, using expensive equipment, and will present it to customers and clients with an important flourish, despite its rather plain and unimpressive outward appearance. Quite often, these materials are presented with no cover or outer folder of any kind. Not only does this create a rather poor impression when the document is presented, but it also creates the likelihood that the document will not have the type of longevity which it often demands, particularly where it is a document that will be preserved in a company's records or will be seen by numerous people. Although the contents of these documents are far more significant than the appearance thereof in the final analysis, it is undeniable that people appreciate well-packaged and attractive works, and that such works, properly presented and packaged, will be better able to survive long periods of consideration and evaluation and frequent readings by users of the documents.

Perhaps the principal reason for the absence of professional appearing documents, reports and the like has been the unavailability of reliable equipment to produce bound reports on a relatively inexpensive basis. Of course, there have been binding machines of various types in the past, which have permitted those having little or no consideration for cost factors to bind their reports and memoranda. However, those types of machines have not generally been available to most smaller firms, offices and groups, due to their complexity and expense. There have also been conventional book binding devices, which major publishing houses and printers have used for documents to be distributed on a very wide scale. But such devices are even more inaccessible to the average person, who requires binding on a less regular basis and who could not, in any event, afford to utilize conventional book binding.

The prior art has recognized these needs and requirements, but has not developed completely satisfactory solutions. For example, the prior art has utlized covers together with separate glue or heat-responsive tapes. These tapes are applied to blank covers from a separate dispenser, and must be cut to size by the user. Besides being expensive and time consuming, this technique does not generally produce as stable a bond to the cover and for the report pages themselves as would be desired.

To overcome this type of disadvantage, the prior art has also developed pre-arranged glue strips which are bonded to the inner spine of a blank cover, and which are set into a semi-rigid state at normal temperatures. When heat is applied to the underside of the cover, with report sheets held in place above the strip, the glue becomes sufficiently viscous to allow the sheet to penetrate the glue, following which the cover is removed from the heat. After cooling, the glue returns to its normal state with the pages now retained in it, resulting in a bound document. These types of covers are in current use with machines having numerous disadvantages — initially, relatively long pre-heating and heating cycles are required to prepare the heating members to activate the glue and to then render the glue molten so the sheets can have the glue applied to their lower edges. A related problem is the uneven and poor distribution of heat by the heating members now in use — while there is often sufficient heat available at the center of a heat channel, there is generally little or no heat at the outer edges of the channel, thus making such devices particularly unsuitable for relatively thick binding jobs.

The prior art machines also exhibit problems with regard to retaining the loose sheets in place firmly enough during the heating cycle so that the binding is done uniformly. the operator is often told to "jog" the sheets so that they at least start out aligned with each other. But most prior art machines fail to provide means to maintain alignment upon insertion of the pages or during the heating cycle. Moreover, other machines try to overcome this problem by providing separate jogging mechanisms and circuitry, including mechanical vibrators beneath or in conjunction with the heating elements, to continuously or periodically oscillate the sheets to assure their alignment and to distribute the glue over their edges. Needless to say, this introduces undesirable motion in the machine and also makes it considerably more expensive.

The covers themselves in current use also are not completely satisfactory. While some covers employ a pre-arranged glue strip, their side elements usually do not have sufficient rigidity in and of themselves to adequately support the loose pages sought to be bound together. Consequently, the pages and the cover element often "flop" to one side or the other and disturb the alignment of the pages during binding. Some machines utilize auxiliary metal spacer plates disposed within the cover to help support the pages and cover, while still other machines use upstanding resilient walls biased toward each other to hold the cover and pages therebetween. These devices are often cumbersome and not formed integrally with the machine body, thus making them less sturdy and reliable for their intended purposes.

The current covers are also limited in scope and application. The covers having inner glue strips are acceptable for many purposes, but are not as versatile as a binding system which would permit other types of fasteners to be used for the report pages. Such other fasteners are already in wide use, and many people are so accustomed to them that they would be reluctant to change to a completely new system. Such fastening methods as looseleaf ring binders, plastic gripping channels and hole-and-prong fasteners should also be available for a comprehensive binding program.

It is therefore an object of this invention to obviate one or more of the aforesaid difficulties.

It is also an object of this invention to provide an integrated binding machine having self-contained and reliable retaining means for the covers and the pages to be included thereof.

It is a further object of this invention to furnish more uniformly distributed heat to the entire cover area during the heating and binding cycle.

It is another object of this invention to utilize binder covers with sufficient rigidity to allow proper alignment of pages during the heating and binding steps.

It is a still further object of this invention to provide a variety of fasteners together with a cover to furnish versatile binding-fastening combinations.

Other objects, features and advantages of this invention will become apparent from a consideration of a particular illustrative embodiment of this invention, wherein a binding machine, having a stationary base and chassis, includes a movable carriage to permit a cover having pages therein to be retained in place during a heating cycle and to be removed thereafter. The base of the machine is provided with an upstanding rear wall which defines one side of a retaining channel against which a cover and its contained pages will be disposed during the insertion and heating cycles. Affixed to the base is a chassis member having a rectangular cut-out region towards the rear of the machine, defining parallel side edges along which carriage rollers may move between open and closed positions. The carriage is moved to an open position by grasping its low forward wall and sliding it by means of its underlying rollers to the forward edge of the rectangular cut-out of the chassis, which acts as a stop for the carriage. When that position is reached, the maximum width of the machine's heating channel is defined, between the upstanding rear wall of the base and the corresponding upstanding rear wall of the carriage. The cover and the pages which are to be bound to the cover by means of this invention are to be inserted into this heating channel between the rear walls of the carriage and the base — the operative width of the heating channel will depend on the thickness of the pamphlet to be bound, and will be described in greater detail hereinafter.

Referring to the heating channel defined between the upper rear walls of the carriage and base, the heat is provided to the underside of the cover spine, which rests against an upper metal plate. Beneath this plate is a printed circuit board which has been encapsulated for ease of packaging and heat distribution. The printed circuit board includes a conductive grid pattern running throughout its entire surface in a mazelike arrangement, to assure the wide and even distribution of heat. This heat is in turn conveyed to the metal plate which is mounted on top of the printed circuit board. In order to insulate the printed circuit board from the remainder of the machine, it is affixed to an asbestos board beneath it, which is in turn mounted on a plate which is attached to the chassis member. In order to monitor the heat which is generated by the printed circuit board and to insure that it reaches but does not exceed the desired temperature for binding, a thermostat is mounted through the chassis support plate and through the asbestos board, enabling the thermostat to make contact with the under surface of the printed circuit board. This permits careful supervision of the heat being supplied to the top metal plate of the heater channel.

When the machine is turned on, power is introduced to the printed circuit board and the thermostat is also activated. With the carriage in its "open" position defining a wide gap between the rear walls of the chassis and base, the report in its cover is placed into the heating channel. The cover has a pre-set glue strip along its inner spine, with the cover having been selected with a view towards accommodating the proper thickness of report pages to be bound within the cover. In addition, thin flexible strips are attached to the inner surfaces of the front and rear elements of the cover, to permit accurate alignment and retention of the pages during the insertion and binding steps. The pages are initially aligned and placed on the glue strip within the inner spine of the cover, which is then folded to contain the pages between its front and rear elements, retained in place by the cover strip elements.

With the carriage still in its open position, the report and its contained pages are placed onto the upper metal plate of the heating channel. The carriage is then moved to the closed position, whereby the upper rear wall of the carriage approaches the upper rear wall of the base; a "closed" position is reached when the carriage wall encounters the cover itself and this position is held throughout the heating and binding cycle. In this position, the flexible strips are pressing the report pages inwardly and tending to retain them in their previously aligned condition. There is sufficient inertia in the carriage such that its rollers do not permit it to slide towards the front of the machine, thus providing a sturdy and reliable retaining position for the cover and pages contained within the cover.

At this point, the timer is set for a predetermined time period depending upon the type of cover being used and the thickness of the report to be bound therein. Following this setting, an energizing button is depressed and the heat is applied to the cover for the period of time set on the timer. When this time has elapsed, the timer automatically shuts the heater element off and provides either a visual or audible alarm. The operator then removes the brochure from the heating channel by moving the carriage forward, thereby releasing the cover. The cover is then placed into a cooling stand which permits the glue to set again and when it has returned to its substantially set position and is no longer viscous or molten, the pages will be firmly retained within the cover.

In addition to the cover having the inner glue strip and the flexible strips along the inner front and rear elements of the cover, the invention also provides for the use of a plain cover to which is adhered a base member having flexible strips and a central glue strip affixed thereto. This permits a standard blank cover, in common use today, to be "converted" to the type of cover which is then capable of being used with the present invention. Similarly, other types of fastening members are utilized with the present invention by furnishing separate fastening channel members adapted to grip report pages in fairly conventional ways. One version of this type of cover is a cover having an inner glue strip to which is affixed a channel member having opposed holes and prongs. Such a channel member is caused to be adhered to the glue strip in the manner described above in this invention, and then pages having holes corresponding to the holes in the channel member can be attached to the channel member by inserting the prongs through the page holes and into the opposite holes of the channel member.

A similar approach allows for the use of a looseleaf ring binder, with such looseleaf rings being affixed to a base member which is adhered to a glue strip on a cover of the type disclosed herein. Following such adhesion, looseleaf pages may be inserted through the conventional rings in the normal fashion.

Another embodiment of a cover under this invention involves the use of a channel member having both interior and exterior glue strips. The interior glue strip is utilized as described above, namely to permit the pages of a report or memorandum to be attached to the channel member under the influence of the heat of the binding machine disclosed herein; the external glue strip, on the bottom of the channel member, is applied to the inner spine of a blank cover element and adheres the channel member to the cover element. When this process has been completed under the influence of heat as described above, a reinforced bound document has been produced, having not only the cover and side strips, but also a channel member securely holding the pages in place. A similar result is achieved by the use of a plastic channel member, in wide use today, which is adhered to a cover along an internal glue strip along the spine of the cover. The pages are retained within the plastic channel member by having the channel member's upper side walls "pinched" inn toward each other, thereby retaining the report pages in place.

Another embodiment of an aspect of this invention is the use of a channel member having an interior glue strip only, and the application of blank sheets to the glue strip in order to form a tear-away pad for note-taking, sketching and writing purposes. In order to insure sufficient rigidity in the binding process and to furnish an outer element against which the carriage and base wall can press towards each other to retain the pages in place, separate plates are utilized to grip opposite sides of each of the outer walls of the channel member, thereby furnishing the needed rigidity. The pages are then inserted within the channel member and the entire "package" is then placed into the heating channel of the machine. Following the application of heat and the conclusion of a cooling cycle as described above, the side plates are removed and a completed pad is available. This type of result can also be accomplished without the use of such plates, in lieu whereof conventional adhesive is applied to the inner surfaces of the outer walls of the channel member to permit adhesion between the pages and the channel member.

It is therefore a feature of an embodiment of this invention that a binding machine includes a carriage movable between an open loading position and a closed binding position, to thereby provide reliable retention and alignment of pages within a cover, between the walls of a carriage and the machine base.

It is another feature of an embodiment of this invention that a heating member consists of a printed circuit element within a heating channel to convey uniformly distributed heat across the entire surface area, corresponding to the binding position of the machine carriage.

It is a further feature of an embodiment of this invention that covers for the binding of loose sheets include a narrow flexible strip on each inner cover surface to urge the sheets together and thereby maintain them in aligned condition during binding.

It is still another feature of an embodiment of this invention that other types of page-fastening devices are adapted to be bound to covers having pre-arranged glue strips, including looseleaf spring binders, hole-and-prong fasteners and plastic channel holders.

It is also a feature of an embodiment of this invention that a group of blank loose sheets can be assembled within a cover to form a pad of sheets for note-taking or writing purposes.

These and other objects, features and advantages of this invention will become more readily understood when considered in connection with a presently preferred, but nonetheless illustrative, embodiment of the invention as explained in the following detailed description and as shown in the accompanying drawing, wherein:

FIG. 13 is a fragmentary and exploded perspective view of another embodiment to be used as a cover with this invention, showing a channel member having internal and external glue strips adapted to be affixed to a cover having parallel positioning strips;

FIG. 14 is a fragmentary end view of a cover utilizing the embodiment of FIG. 13;

FIG. 15 is still another embodiment of a cover to be used with this invention, showing a looseleaf ring binder element to be affixed to a cover having a central glue strip;

FIG. 16 is a fragmentary end view of a cover utilizing the embodiment of FIG. 15;

FIG. 17 is also an embodiment of a cover to be used with this invention, showing a resilient "pinching" member to be affixed to a cover having a central glue strip;

FIG. 18 is a fragmentary end view of a cover utilizing the embodiment of FIG. 17;

Figure 1:
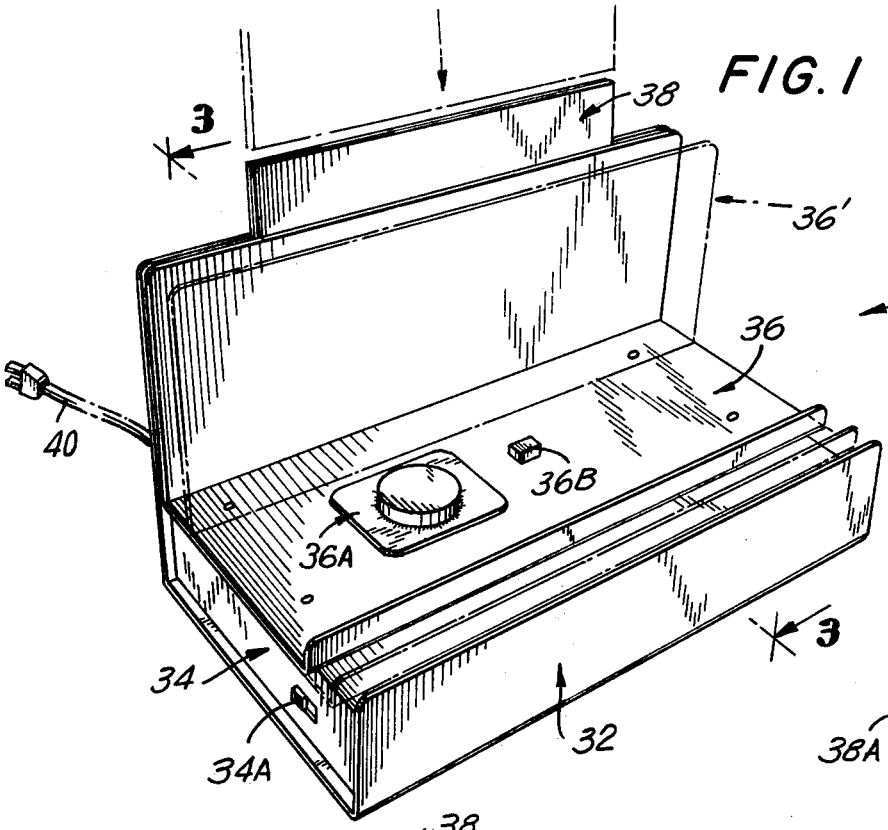
FIG. 1 is an overall perspective view of the machine of this invention, showing the upper carriage in two positions and containing a cover for binding in one of these positions.

An overall perspective view of the machine of this invention is given in FIG. 1, with the reference numeral 30 being assigned to the machine in general. The major component parts of the machine include the underlying and stationary base 32, to which is affixed the chassis 34. To the left of FIG. 1 is indicated the controlling on-off switch 34A for the machine's circuitry. Mounted above the chassis and movable with respect thereto is carriage plate 36. As indicated in FIG. 1, this plate can be moved from the phantom position 36′ which is the open or loading position for the machine, to the full line position indicated at 36. At this latter position, binding cover 38 is inserted between the rear wall of carriage 36 and the upstanding rear wall of base 32. As noted by the downwardly directed arrow above binder 38 in FIG. 1, the binder is inserted from above, with the sheets to be bound therein, when the carriage is at the 36′ position. Following insertion of the cover, the carriage is moved to the full line 36 position. Power for the machine is provided by conventional line current, supplied to line cord 40.

Figure 2:
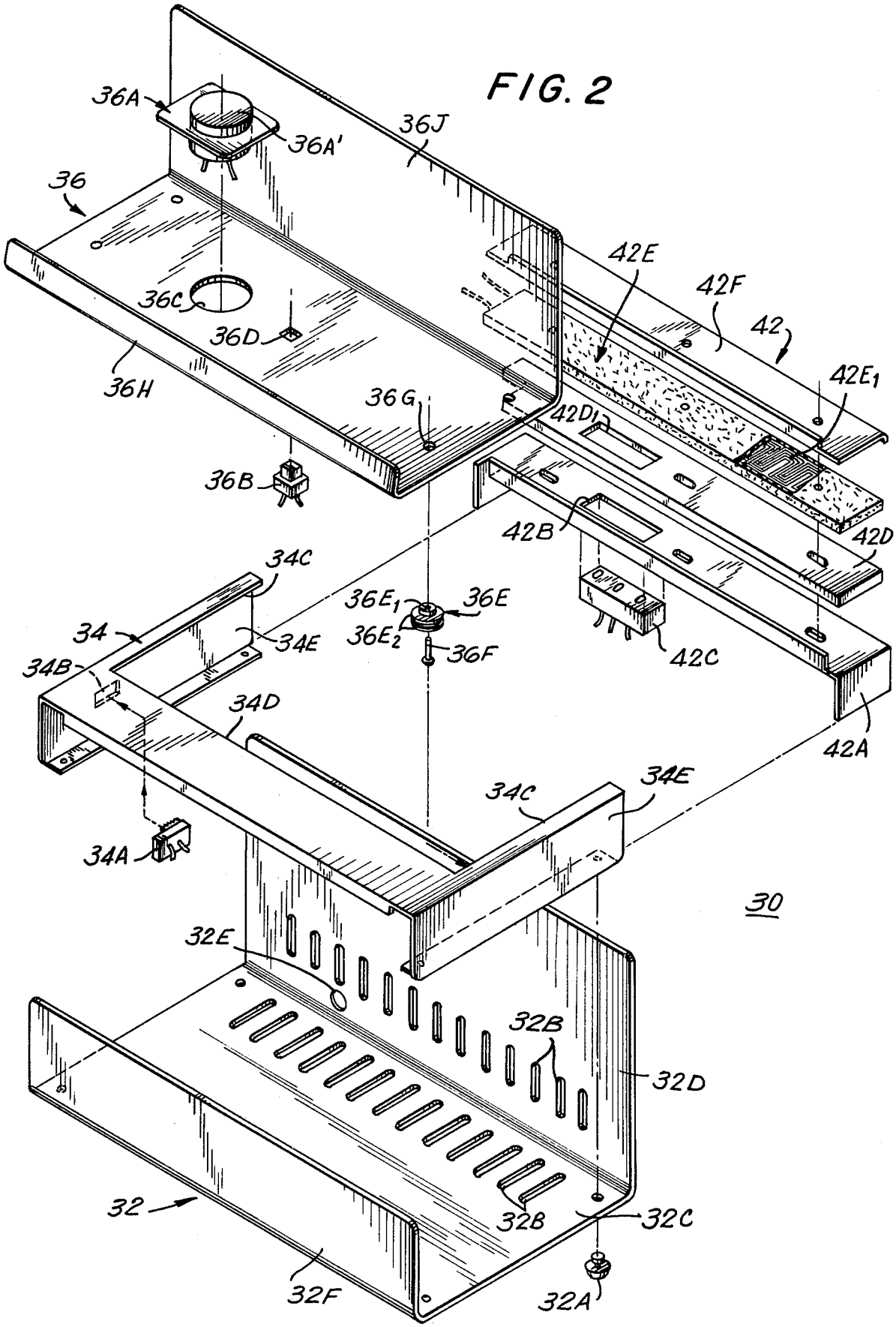
FIG. 2 is an exploded perspective view of the machine of the invention showing the component parts thereof.
Figure 3:
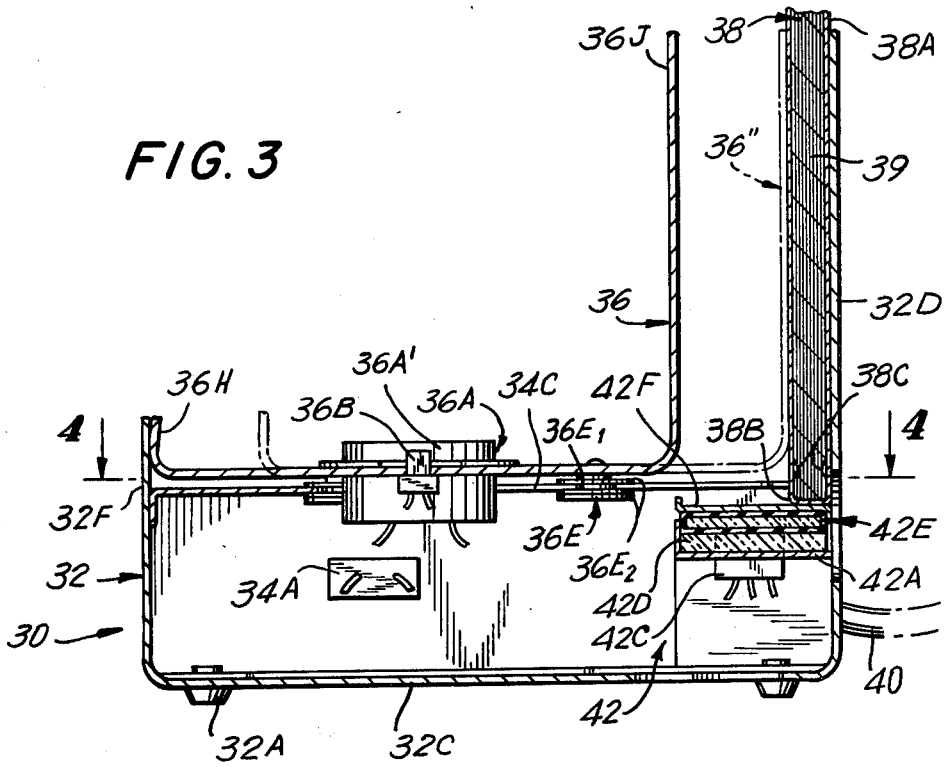
FIG. 3 is a sectional view of the machine showing the carriage in its two positions and a cover in place for binding, taken along the discontinuous section line 3—3 of FIG. 1 in the direction of the arrows.
Figure 4:
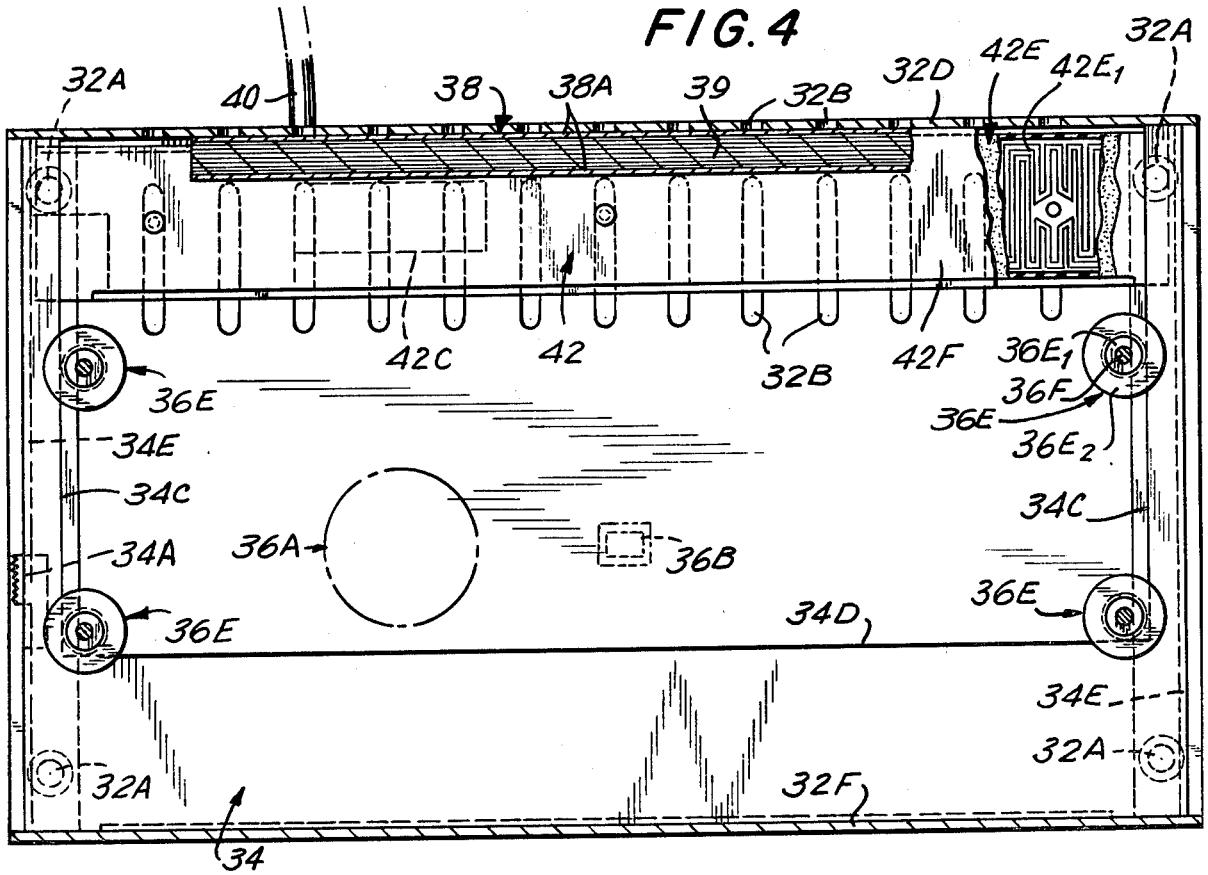
FIG. 4 is a top sectional view of the machine showing the manner of movement of the carriage with respect to the chassis, and partly broken away to illustrate the heating element, taken along the lines 4—4 of FIG. 3 in the direction of the arrows.

A more complete and detailed understanding of the components of the machine can be obtained from a consideration of FIGS. 2, 3 and 4. The exploded view of FIG. 2 shows underlying base 32 having rubber feet 32A passing through four corner holes in the bottom surface 32C of the base, and ultimately being affixed through corresponding holes in the bottom edges of chassis 34. Groups of bottom and rear wall vents 32B are also employed in base 32 to allow for sufficient escape of heat generated during the operation of the machine. The upstanding rear wall of the base is indicated at 32D and includes in addition to vents 32B, an aperture 32E to accommodate the line cord 40 (not shown in FIG. 2). The front wall 32F of base 32 serves to contain the chassis member 34.

Chassis 34 is attached to base 32 by means of upward lugs on rubber feet 32A; the chassis may also be secured to the base in numerous other conventional ways. The on-off switch 34A projects out through a rectangular opening 34B in the left side wall of chassis 34. Chassis 34 is provided with a deep cut-out region bounded by side edges 34C and front edge 34D. These edges define the front-to-rear travel of the carriage 36 by providing edges along which carriage rollers 36E can ride. When the frontmost rollers 36E (as seen at the bottom in FIG. 4) reach front edge 34D (and the front wall 36H of the carriage contacts wall 32F), the carriage is at its maximum open position, as seen for example at 36′ in FIG. 1.

The carriage 36 itself includes a combined timer and switch mechanism 36A and a heater indicating light 36B, which are accommodated within corresponding apertures 36C and 36D in the main horizontal surface of carriage 36. The rollers 36E are attached from the bottom to carriage 36 by means of bolts 36F; the rollers 36E consist of an upper hub $36E_1$ which bears against the bottom of carriage 36 (see FIG. 3), and spaced concentric flanges $36E_2$ between which the edges 34C of chassis 34 are disposed to permit rollers 36E to slide along those edges. The rollers 36E are mounted through holes 36G in the surface of carriage plate 36. Carriage plate 36 is illustratively moved by grasping lower front wall 36H and moving it in the desired direction, whereby rollers 36E slide along edges 34C of the chassis. As carriage 36 is moved rearwardly, its upstanding rear wall 36J moves toward the corresponding wall 32D of base 32, and when the cover holding the pages to be bound is securely retained between carriage wall 36J and base wall 32D, the binding position of the machine has been reached.

The overall heating assembly 42, as shown in FIG. 2, includes an underlying metal bracket plate 42A which may be welded to the side walls 34E of the chassis at the rear ends thereof. In addition to the conventional mounting holes and apertures, a rectangular cutout 42B is included in bracket 42A in order to accommodate thermostat 42C therethrough. Mounted above bracket 42A is insulating strip 42D, which may preferably be made of asbestos or other suitable material. A corresponding cutout $42D_1$ is included in insulating board 42D to further accommodate the upward penetration of thermostat 42C — as seen in the view of FIG. 3, thermostat 42C may thereby contact the underlying surface of encapsulated printed circuit board 42E, which is the next upper layer in the heating assembly. As shown in broken-away fashion in FIG. 2 (also see FIG. 4), the encapsulated circuit board 42E includes a conductive grid pattern $42E_1$ which is maze-like in character. When power is supplied under appropriate timed conditions to the conductors of board 42E, substantially uniformly distributed heat is provided across the entire width of board 42E, by virtue of the side-to-side grid pattern $42E_1$. This heat is conducted upwardly to uppermost heat assembly member 42F, which is preferably made of highly heat conductive metal, such as aluminum. It is this plate 42F which actually makes contact with the under surface of the binder cover which has the glue strip on its inner spine and the pages to be bound thereto held in contact with the glue strip.

Figure 6:
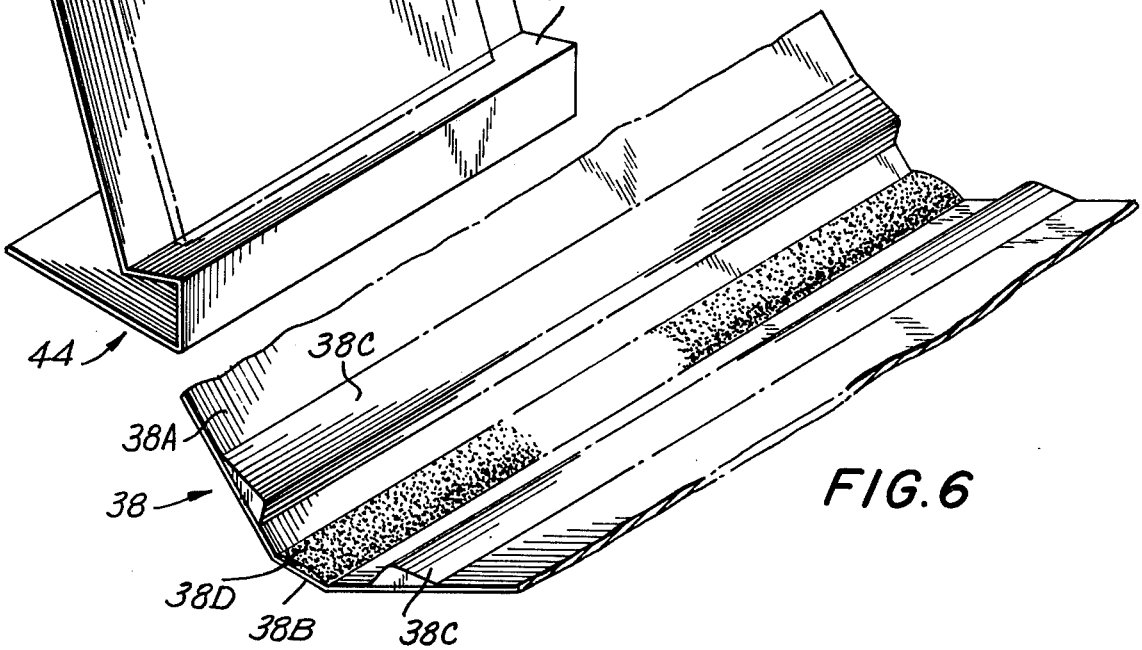
FIG. 6 is a fragmentary illustration of a cover for use in connection with this invention, showing the cover, central glue strip and parallel flexible positioning strips.

Reference will now be made to the preferred embodiment of a cover to be used with the machine of this invention; additional cover embodiments will be described hereinafter. Considering FIGS. 6 and 7, the cover is generally indicated at 38, and includes front and rear portions 38A and a central spine 38B. Mounted along the full height of the front and rear portions 38A are parallel flexible strips 38C, generally having a triangular or other suitably projecting cross-section, such as circular or convex. Mounted on the inner surface of central spine portion 38B is a strip 38D of a pre-set glue, such as Y12-570 which is available commercially from Swift Chemical Company of New York. This glue strip 38D can preferably be applied to the inner spine 38B by a direct extrusion process at a sufficiently low temperature such that the glue strip does not lose any of its adhesion properties and yet is appropriately affixed to the full width of the inner spine 38B.

Figure 7:
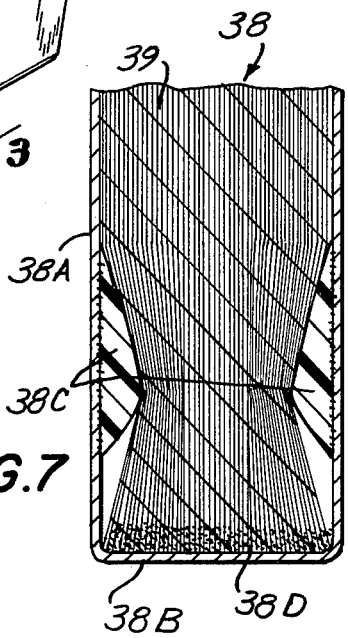
FIG. 7 is a fragmentary end view of a bound pamphlet or document achieved with this invention, showing the pages, positioning strips and glue dispersed within the lower edges of the pages.
Figure 5:
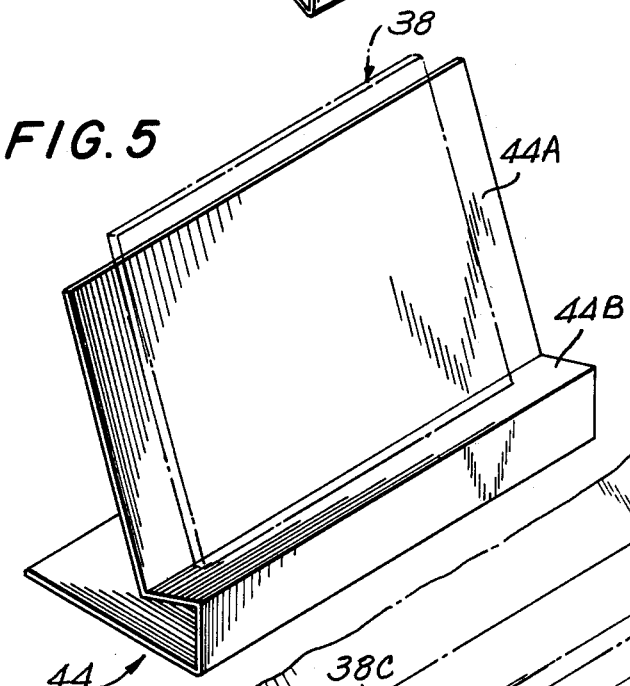
FIG. 5 is a perspective view of the cooling stand of the invention, showing in phantom a typical bound document disposed thereon following the conclusion of a heating cycle.

In order to use cover 38 in conjunction with this invention, sheets 39 (FIG. 7) to be bound within cover 38 are aligned by the operator and are placed within the cover 38, residing on top of pre-set glue strip 38D in its original condition. To accommodate sheets 39, cover 38 is first folded at the junction edges between front and rear portions 38A and spine 38B, to permit the cover, with the pages loosely held therein, to be placed in the machine. As cover portions 38A are folded toward each other, strips 38C serve to press towards each other at their oppositely disposed apexes, as best shown in FIG. 7. This provides sufficient retention action to allow sheets 39 to be held in place in their aligned condition and with their lower edges substantially in contact with glue strip 38D. It is in this condition that the cover 38 will be placed into the loaded position of the machine to be described below and heat is applied to the under surface of spine 38B. The glue strip 38D then becomes sufficiently viscous and molten to permit sheets 39 to draw glue 38D into their lower portions, for example by capillary action. Following the heating cycle, the cover 38 is withdrawn from the heating channel as will be described and placed into cooling stand 44. Because of the angle to the horizontal defined by resting surfaces 44A and 44B of stand 44, the cover 38, shown in phantom in FIG. 5, can allow the interior glue strip 38D to set once again, and after an appropriate cooling period of about thirty seconds, the binding process is complete.

To better comprehend the operation of this machine, a complete cycle of the machine will now be described. The initial step, of course, is to plug line cord 40 into a standard alternating current source. Once this preliminary step has been accomplished and it is desired to activate the machine, switch 34A is placed in the "on" position, thereby applying available power to the conductors of printed circuit board 42E, which energizes the conductors of grid pattern $42E_1$ (FIGS. 2 and 4), to thereby heat the heating assembly 42. Because of the use of a printed circuit board 42E in this invention, the pre-heating cycle that has been required with prior art machines is completely dispensed with — thus, instead of several minutes of pre-heating time, no specific "warm-up" period will be required before binding can commence. This operational improvement is largely attributable to the use of printed circuit board 42E, which provides the direct advantages of furnishing substantially uniform heat distribution across its entire width and yielding higher watt density ratings (i.e., heat capacity per unit time) than have been available heretofore. Since the heat source is in the form of a relatively flat element, better heat control is also achieved due to the accessibility of the board 42E to thermostat 42C, which can now be in direct contact with the heat source and thus capable of more accurate monitoring of the heat cycle.

A cover 38 of an appropriate width to accommodate the number of sheets to be bound is selected, and the sheets to be bound therein are aligned and placed onto the glue strip 38D on the inner surface of the spine 38B of the cover. The cover is then folded as discussed above, with strips 38C pressing the sheets inwardly as indicated in FIG. 7. In this aligned and retained condition, the cover is ready to be inserted into the machine. The machine is prepared to accommodate the cover when its carriage 36 is moved to the phantom position 36' as indicated in FIG. 1. This is done by the operator's grasping low forward wall 36H of carriage 36 and drawing it back to the point where that wall 36H comes into contact with front wall 32F of chassis 32 — this may be designed to coincide with the arrival of forwardmost rollers 36E against edge 34D of the cutout in the upper surface of chassis 34, as shown in FIG. 4. When the open or loading position is reached, as indicated by the solid line position at 36 in FIG. 3, cover 38 with its contained pages 39 is placed into the heating channel whose rear surface is defined by the upstanding rear wall 32D of chassis 32. As shown in FIGS. 3 and 4, the under surface of central spine 38B is thereby placed into contact with upper metal plate 42F of heating assembly 42. In order to securely retain cover 38 in this binding position as shown in FIG. 3, carriage 36 is then moved rearward by the operator, either by grasping forward wall 36H or by pushing against upstanding rear wall 36J of the carriage. In so doing, rollers 36E are permitted to slide along the parallel inner edges 34C of the chassis, moving the entire carriage back towards the binding position. The carriage then arrives at position 36" in FIG. 3, whereby rear wall 36J of the carriage is in contact with the left cover element 38A and is gently pressing the cover towards the rear wall 32D. In this position, the cover is ready for binding action.

The appropriate timing setting has been made on timer 36A previously, whereby a suitable heating cycle is selected — for a typical cover to be used with this invention, a heating cycle of thirty seconds may be selected — if the machine is operated relatively infrequently during a given day, a slightly longer cycle of up to one minute may be chosen. In order to commence this cycle, timer switch portion 36A' is depressed and timer 36A then commences to run. The activation of switch 36A' should occur as soon as carriage 36 reaches position 36" as shown in FIG. 3. At the conclusion of the timing cycle, power will be removed from the conductors connected to printed circuit board 42E, and this will cause the heat to gradually dissipate from heating assembly 42. The termination of the timing cycle may also be indicated by a suitable audible or visual alarm, such as a click, tone or light (not shown), and this will alert the operator to the completion of the heating cycle. At this point, therefore, the cover can be removed from the binding position indicated at 36" in FIG. 3.

During the actual heating cycle, heat will have passed upwardly from printed circuit board 42E and onto heat conductive metal plate 42F which is actually in contact with the under surface of spine 38B. This will cause glue strip 38D to become viscous and to allow the glue to be dispersed in and around the lower edges of sheets 39 held within cover 38 by flexible side strips 38C. Upon removal from the heating position at the conclusion of the timed heating cycle, the cover is placed into cooling stand 44, shown in FIG. 5. As previously indicated, surfaces 44A and 44B cooperate to provide a resting angle with respect to the horizontal, such that bound cover 38 may permit its glue 38D to cool and set, and cover elements 38A remain in their closed position. Following a brief cooling period of thirty seconds, the bound cover is completed and is available for immediate use.

Figure 8:
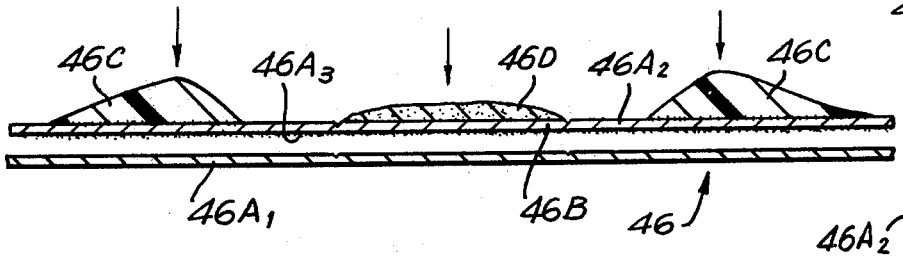
FIG. 8 is an end view of an alternate embodiment of the cover for this invention, showing a blank cover and a conversion element having positioning strips and a glue strip thereon.
Figure 10:
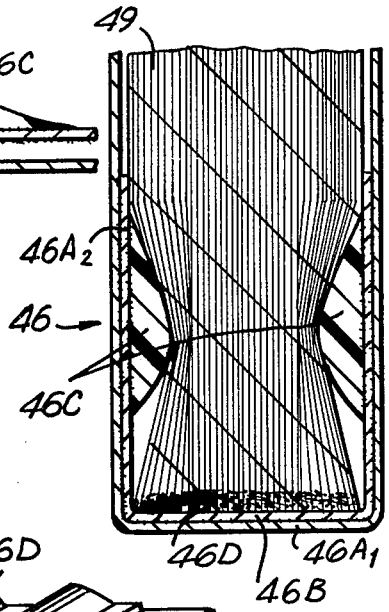
FIG. 10 is a fragmentary end view of a cover employing the conversion strip shown in FIGS. 8 and 9.
Figure 9:
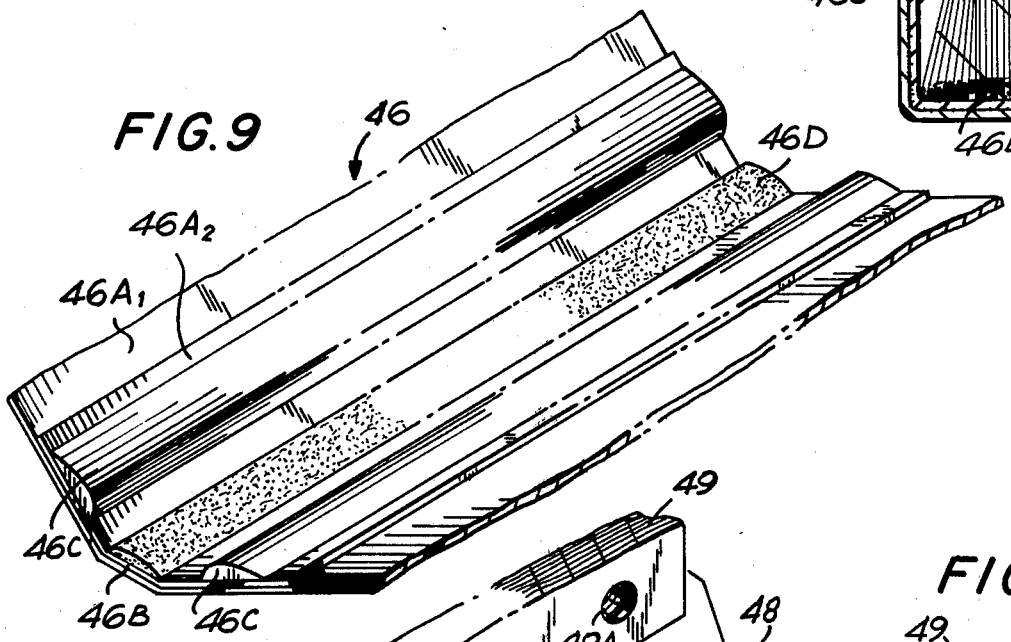
FIG. 9 is a fragmentary perspective view of a cover utilizing the conversion element of FIG. 8.

An alternate embodiment of the cover to be used in conjunction with this invention is illustrated in FIGS. 8, 9 and 10. This type of cover is designed to "convert" existing blank covers to those having glue strips and flexible strips, as has been discussed above. One principal reason for this arrangement is to permit the use of the currently available blank covers, which are not only in wide use, but of which there are great inventories in the hands of consumers and at the same time to take advantage of the present invention.

Referring initially to FIGS. 8 and 9, the overall cover assembly is identified as 46. This assembly consists of a blank cover having fold lines and other conventional characteristics of covers generally available today, but not having any of the properties of the covers of this invention — this conventional cover is identified as $46A_1$. The conversion element to change the standard cover 46A, to one which can be used with this invention is indicated at $46A_2$, and includes a basic cover element having a suitable adhesive composition (e.g., pressure-sensitive adhesive) on its under surface at $46A_3$. Mounted on the upper surface of conversion element $46A_2$ are the parallel retaining strips 46C and the glue strip 46D, which is mounted on the inner surface of spine 46B of element $46A_2$. In order to prepare the cover assembly 46, surface $46A_3$ is brought into contact with the upper surface of blank cover $46A_1$, and by the application of suitable and uniform pressure to the conversion member $46A_2$, an adhesion takes place between that member and blank cover $46A_1$. This causes the formation of assembly 46 as indicated in FIG. 9.

The use of converted cover assembly 46 is then substantially as indicated above with respect to cover 38. Thus, the converted assembly is folded at the junction edges where the front and rear cover portions meet the portion of blank cover $46A_1$ which underlies spine 46B. The pages 49 are inserted into the cover assembly with their lower edges in contact with glue strip 46D. Upon folding of the side members toward each other, strips 46C apply inward pressing action and serve to retain the aligned pages 49 within the cover assembly 46. This entire retained assembly is then placed into the heating channel of the machine, with the bottom portion of cover $46A_1$ in contact with heating plate 42F. Following closure of carriage 36 as previously described, the heating cycle is commenced by activation of timer 36A and switch 36B, causing heat to pass up through spine 46B to thereby render glue 46B somewhat viscous, permitting the binding process to proceed. The completion of the heating cycle by the timing out of timer 36A and the removal of completed cover assembly 46 is as described above, and need not be repeated here.

Figure 11:
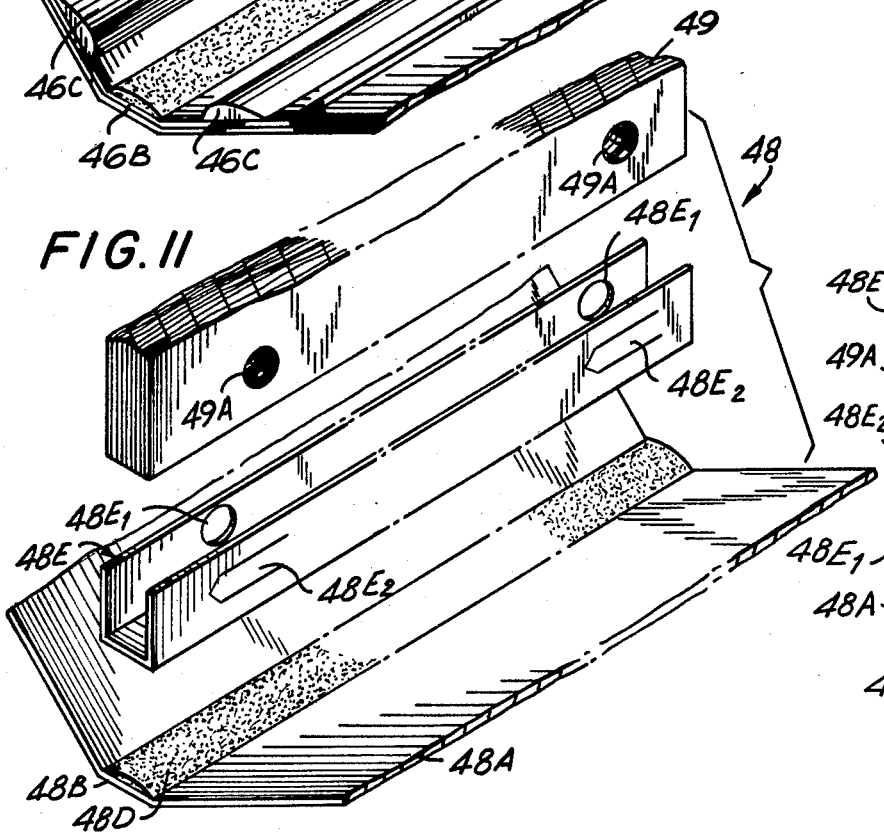
FIG. 11 is a fragmentary perspective view of another alternate embodiment of the cover to be used with this invention, illustrating a hole-and-prong channel to be affixed to a cover having a central glue strip.
Figure 12:
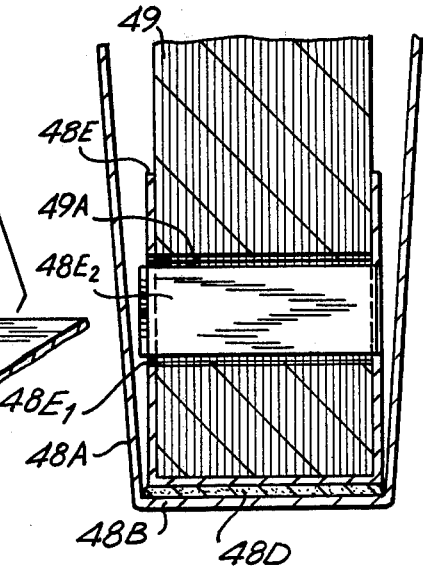
FIG. 12 is a fragmentary end view of a cover utilizing the embodiment of FIG. 11.

A further embodiment of a cover to be used with the present invention is indicated in FIGS. 11 and 12. This arrangement permits the cover of the present invention to be utilized with a channel member to thereby adapt the invention to a well-known type of fastener currently in use, namely a hole-and-prong arrangement. As shown in the view of FIG. 11, cover 48 is of the type previously disclosed herein, except that no flexible strips are contained along front and rear cover portions 48A. Glue strip 48D is included on the inner surface of spine 48B. A supplemental member in the form of channel 48E is included in this embodiment, containing holes $48E_1$ along one side wall and prongs $48E_2$ in the opposite wall which are capable of being bent towards and through corresponding holes $48E_1$. Holes $48E_1$ are spaced in accordance with standard page spacing and correspond to the separation of page holes 49A.

To utilize this embodiment, pages 49 are initially placed within channel member 48E, and holes $48E_1$ are aligned with holes 49A. Prongs $48E_2$ are then bent through page holes 49A and project out past holes $48E_1$; thereafter, they are bent towards the top of channel 48E to secure pages 49 within channel 48E. This channel member, with the contained pages securely held therein by prongs $48E_2$, is then placed into contact with glue strip 48D, and the sides 48A of cover 48 are then folded up in the manner described. In this folded condition, the cover is placed into the heating channel of the machine, with spine region 48B in contact with heating plate 42F (see FIG. 3). After suitable timing, removal and cooling, as previously described, the cover is completed in the bound condition indicated in FIG. 12. Another advantage of this embodiment is that pages can be removed from or added to such a cover following completion of the binding process — all that is required is that prongs $48E_2$ be bent away from their secured position and withdrawn through page holes 49A. Pages may then be removed or added, provided that their holes are lined up with existing holes $48E_1$ of channel 48E and holes 49A of the existing pages. The prongs $48E_2$ are then reinserted through the page holes and are secured on the opposite side of the channel member 48A as previously described.

In the embodiment shown in FIGS. 13 and 14, a blank cover assembly 50 is utilized in conjunction with a special channel member to permit the present invention's advantages to be utilized. Specifically, blank cover 50A includes spine region $50A_1$ having no glue strip thereon and no flexible side strips. The essential component of this embodiment is channel 50E, having glue strips $50E_1$ and $50E_2$ on opposite sides of channel member spine region $50E_3$. In particular, glue strip $50E_1$ is located on the under side of channel member 50E at the spine region, while glue strip $50E_2$ is disposed on the upper surface thereon. Channel 50E also includes interior facing strips 50C to provide inward retaining pressure against the pages to be bound. In actual use, pages 50B are aligned and placed within channel member 50E, with the lower edges of pages 50B in contact with upper glue strip $50E_2$. Channel member 50E in turn is placed onto the blank inner surface of spine region 50A, and cover portions 50A are folded over at their respective junction edges with spine $50A_1$ as has previously been described in connection with other cover embodiments above. As cover members 50A are folded inwardly towards each other, strips 50C of channel member 50E, shown illustratively as semi-circular in cross section (FIG. 14), press pages 50B inwardly and retain the pages in their aligned condition within channel member 50E.

In this aligned condition, the cover assembly 50 is placed into the heating channel of the machine, with the under surface of spine region $50A_1$ in contact with heating plate 42F. During the progress of the heating cycle, activated by timer 36A and switch 36B, the upward conduction of heat through spine region 50A$_1$ initially reaches underlying glue strip 50E$_1$ and serves to liquify that glue strip member. This permits the bottom surface of channel member 50E to be adhered to the upper inner surface of spine region 50A$_1$. The further conduction of heat supplied by heating plate 42F passes through spine member 50E$_3$ of channel member 50E and causes upper glue strip 50E$_2$ to become viscous. This viscosity permits the glue to be dispersed among the lower edges of pages 50B during the heating cycle. Upon termination of the heating cycle and removal of the bound report from the machine, the cooling cycle permits the glue of strips 50E$_1$ and 50E$_2$ to set, making the overall cover assembly a finished and secure member.

In FIGS. 15 and 16, an embodiment of this invention is shown whereby the invention may be utilized in connection with another type of conventional binding member, namely a looseleaf ring binder. As seen in FIG. 15, element 52E includes a bar having looseleaf rings 52E$_1$ mounted thereon with conventional spacing corresponding to the separation of holes 52B$_1$ of sheets 52B. The cover member itself includes front and rear side portions 52A and central spine portion 52A$_1$; glue strip 52D is affixed to the upper inner surface of spine region 52A$_1$. The finished version of FIG. 16 is developed by placing element 52E on top of glue strip 52B, and placing this arrangement, with or without pages 52B, into the heating channel of machine 30. After the heating cycle and the cooling provided by cooling stand 44, element 52E has been affixed to the cover. Thereafter, pages 52H$_1$ can be inserted onto rings 52E$_1$ in conventional fashion, resulting in the arrangement indicated in FIG. 16.

The embodiment of FIGS. 17 and 18 utilizes a plastic angle bracket 54E, into which pages are designed to fit and to be retained by the inward pressure of the side walls 54E$_1$. This embodiment is utilized by placing pages 54B within channel member 54E, and placing this composite onto glue strip 54D on spine region 54A$_1$. The resultant assembly is placed into the heating channel after the heating cycle has been completed, and the arrangement of FIG. 18 results, with channel member 54E being affixed to the inner spine 54A$_1$ of the cover by means of the reset glue strip 54D.

Figure 19:
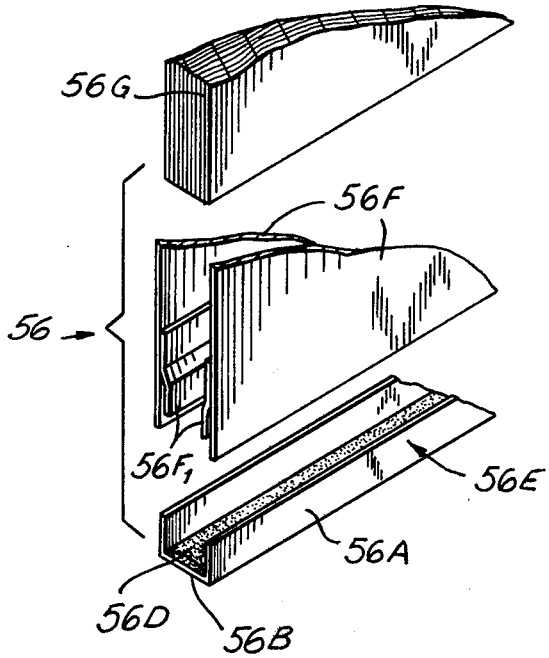
FIG. 19 is an exploded and fragmentary perspective view of another embodiment of this invention, whereby a channel member having a central internal glue strip is utilized with support plates to form a pad of sheets.
Figure 20:
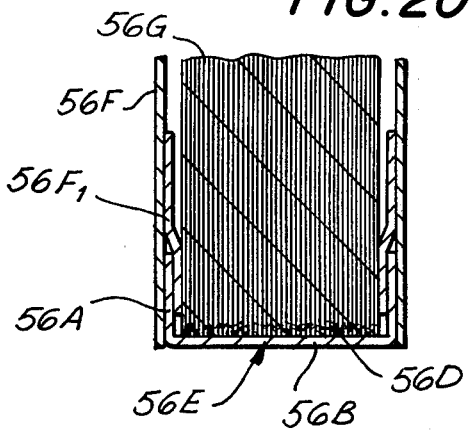
FIG. 20 is a fragmentary end view of a cover utilizing the embodiment of FIG. 19, showing the plates still in place.

In considering the embodiment of FIGS. 19–22, it should be kept in mind that there is also a need in many office and educational situations for preparing writing materials such as pads, and also for producing bound documents on a relatively low cost basis, where the visual impression may not be as significant as those embodiments referred to above. As shown in FIGS. 19 and 20, for example, channel 56E is designed to accommodate pages 56G in the form of a pad of sheets of paper, without the cover element which has been discussed heretofore. In use, channel 56E includes a central spine region 56B and upstanding side walls 56A. As has been discussed previously, glue strip 56D is applied to the inner surface of spine region 56B. Since the normal disposition of sheets 56G within channel member 56E would result in the "flopping" of the pages over the sides and the resultant non-retention of the pages therein, spacer plates 56F are used in conjunction with channel member 56E.

Referring to the end sectional view of FIG. 20, it is seen that plates 56F have corresponding inwardly directed resilient fingers 56F$_1$ on the inner faces of the plates. The lower portions of these fingers are spaced away from the plates' inner faces to provide a space therebetween to receive the upstanding walls 56A of channel member 56E. The resiliency of fingers 56F$_1$ is in the inward direction, and the combined biasing of both opposed fingers urges the lower edges of pages 56G towards each other, thereby retaining them in place during the binding process.

Figure 22:
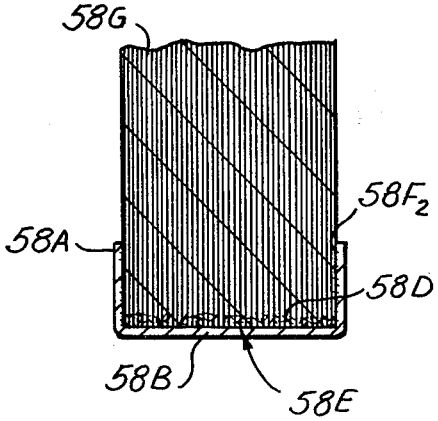
FIG. 22 is a fragmentary end view of a pad formed from the embodiment of FIG. 21.

When spacer plates 56F have been inserted such that fingers 56F$_1$ fit over walls 56A, the position essentially as shown in FIG. 20 is reached. That arrangement, including spacer plates 56F, is then placed into the heater channel of the machine, with the lower surface of spine 56B in contact with upper heating element 42F. After suitable application of heat followed by cooling as previously described, the glue permeates the lower edges of the sheets and the pad is formed between channel member 56E and sheets 56G — this is essentially as shown in FIG. 22, following the removal of spacer plates 56F.

Figure 21:
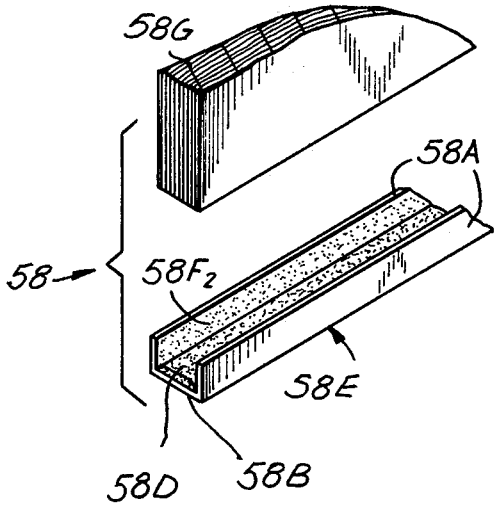
FIG. 21 is an alternate embodiment of the pad arrangement shown in FIGS. 19 and 20, whereby the channel member has an internal glue strip and adhesive along its side walls.

In FIG. 21, an arrangement is shown which dispenses with the need for the previously described spacer plates 56F. In particular, channel member 58E in that illustration includes the same glue strip 58D on spine region 58B. However, on the inner surfaces of upstanding side walls 58A is a pressure sensitive adhesive 58F, illustratively protected from external damage by conventional peelable strips (not shown). When this embodiment is utilized, the sheets 58G are placed into channel member 58E without the use of any spacer plates, and after the peelable side strips covering adhesive 58F are removed. By the application of pressure along the side walls 58A and inwardly between the walls, the sheets 58G are adhesively retained within channel 58E. The composite structure is then placed into the heating channel of the machine and the application of heat as previously described causes glue strip 58D to become viscous, to permeate the lower sheets 58G and, following appropriate cooling, to result in the finished pad structure shown in FIG. 22.

There are also other embodiments which can be utilized with this invention, to permit the accommodation of numerous other material fastening devices either in use or which will be developed hereinafter. For example, a pressure sensitive adhesive can be used on the outside face of channel members such as 56E and 58E in FIGS. 19–22. This could permit the user to affix his own "homemade" covers to the outer surface of the channel member after the document has been bound therein. This would allow the use of less expensive covers having only a single sheet surface, whereby the user could avoid the possibly greater expense of custom-made covers for certain low-cost applications. This outside adhesive would also be covered prior to actual use by a peelable strip which would be removed when it is desired to apply the user's own cover thereto.

It is to be understood that the above-described embodiments are merely illustrative of the applications of the principles of this invention. Numerous variations may be devised by those skilled in the art without departing from the spirt or scope of the invention.

What is claimed is:

1. Apparatus for affixing a plurality of loose pages into bound form comprising binding means for receiving said pages in cooperation with a glue member thereon, a chassis having an upper carriage means movable between a loading position loosely accommodating said binding means with said pages therein and a binding position to retain said binding means with said pages therein, heating assembly means mounted on said chassis and substantially underlying said carriage means said binding position for providing heat to said binding means during a binding cycle to melt said glue member, timing means for controlling the application of heat from said heating assembly to said binding means and indicating means for signaling the conclusion of said binding cycle, wherein said heating assembly means comprises printed circuit means for providing said heat to said binding means and conductive means for conveying said heat from said printed circuit means to said binding means.

2. Apparatus in accordance with claim 1 wherein said heating assembly means further includes support means connected to said chassis and an insulating member mounted on said support means and carrying said printed circuit means thereon.

3. Apparatus in accordance with claim 2 wherein said support means is a bracket fixedly mounted to said chassis and having a window aperture therethrough, said insulating member includes a window aperture aligned with said apparatus of said bracket and said conductive means includes a heat-conducting plate mounted above said printed circuit means to provide heat directly to said binding means during said binding cycle.

4. Apparatus in accordance with claim 3 wherein said heating assembly means further includes thermostat means for limiting the heat provided by said printed circuit means.

5. Apparatus in accordance with claim 4 wherein said thermostat means comprises a thermostat control mounted through said window apertures of said bracket and said insulating member and having a detecting surface in contact with said printed circuit means.

6. Apparatus in accordance with claim 5, wherein said heating assembly means includes an electrical power source, and wherein said printed circuit means comprises a board with said edges and having an electrically conductive grid pattern therein extending between said edges to provide uniform heat distribution thereacross in response to the application of power from said source.

7. Apparatus in accordance with claim 1 including a support base for receiving said chassis in a fixed position thereon, said chassis having an upper surface with a cut-out region defined by a pair of opposed side edges to transport said carriage therealong and a front edge between said opposed side edges and acting as a stop for said carriage to define the limit of said loading position, and wherein said carriage includes end edges corresponding to said side edges of said chassis and transport means mounted at said end edges and in engagement with said side edges to permit reciprocating movement of said carriage between said loading and binding positions.

8. Apparatus in accordance with claim 7 wherein said transport means comprises at least one roller mounted for rotational movement with respect to said end edges, each of said rollers including means for gripping said side edges of said chassis for sliding movement therealong.

9. Apparatus in accordance with claim 8 wherein a pair of said rollers is mounted at forward and rear positions of said end edges of said carriage, said chassis having an upper surface and a lower surface for receiving said gripping means, and wherein said gripping means of each of said rollers comprises an upper flange in contact with said upper surface, a lower flange in contact with said lower surface and a central hub in sliding contact with the corresponding one of said side edges of said chassis.

10. Apparatus in accordance with claim 7 wherein said support base includes a forward wall and a rear upstanding wall, and said carriage include a forward wall adapted to be moved toward said forward wall of said base to define said limit of said loading position and a rear upstanding wall adapted to be moved toward said rear upstanding wall of said base to define the limit of said binding position, said binding means being loaded when said forward walls of said base and said carriage are adjacent to each other and said pages being bound into said binding means during said binding cycle when said binding means is retained between said rear upstanding walls of said base and said carriage.

11. Apparatus in accordance with claim 1 wherein said binding means includes a front cover portion, a rear cover portion, a spine portion between said cover portions and an auxiliary cover insert having a front segment corresponding to at least the innermost area of said front cover portion, a rear segment corresponding to at least the innermost area of said rear cover portion and a spine segment between said front and rear segments and corresponding to said spine portion, said insert further including adhesive means on the surfaces of said front, rear and spine segments facing said front and rear cover portions and said spine portion for affixing said insert to said binding means, and wherein said glue member is affixed to said spine segment of said insert, said front and rear segments of said insert having page retaining means disposed thereon for holding said pages in substantial alignment with each other when said front and rear cover portions are brought towards each other at said loading and said binding positions, after said insert has been affixed to said binding means.

12. Apparatus in accordance with claim 11 wherein said page retaining means includes a strip substantially parallel to said spine segment and having a projecting region for making contact with said pages as said cover portions are brought towards each other to thereby maintain said pages in aligned condition for binding together.

13. Apparatus in accordance with claim 1 wherein said binding means includes a front cover portion, a rear cover portion, a spine portion between said cover portions, said glue member being affixed to said spine portion, and page retaining means adapted to be adhered to said glue member during said binding cycle for holding said pages in said binding means.

14. Apparatus in accordance with claim 13 wherein said pages have a pair of gripping holes therethrough, and said page retaining means comprises a U-shaped channel having a pair of upstanding retaining walls, a first of said walls having a pair of mounting holes corresponding to and aligned with said gripping holes in said pages and a second of said walls having a pair of flexible prongs for insertion through said gripping holes of said pages and said mounting holes of said first wall and adapted to be releasably engaged against said first wall to achieve said bound form for said binding means and pages.

15. Apparatus in accordance with claim 13 wherein said pages have a pair of gripping holes therethrough, and said page retaining means comprises a panel substantially coextensive with said spine portion and having a pair of ring fasteners corresponding to said gripping holes for holding said pages in looseleaf relation in said cover.

16. Apparatus in accordance with claim 13 wherein said page retaining means comprises a bracket having a bottom wall in contact with said glue member and a pair of upstanding walls positioned at respective interior acute angles to said bottom wall, defining a gap between the upper edges of said upstanding walls, said pages being retained against said bottom wall and within said upstanding walls, said upstanding walls providing inward gripping action against said pages at said gap.

17. Apparatus in accordance with claim 1 wherein said binding means includes a front cover portion, a rear cover portion, a spine portion between said cover portions and page retaining means having said glue member therein for affixing said pages thereto.

18. Apparatus in accordance with claim 17 wherein said page retaining means comprises a U-shaped channel having a pair of upstanding walls and a spine segment between said walls corresponding to said spine portion of said binding means, said spine segment having an upper surface carrying said glue member and a lower surface facing said spine portion of said binding means and carrying a mounting glue strip to affix said spine segment of said channel to said spine portion of said binding means while said pages are affixed to said glue member of said channel during said binding cycle.

19. Apparatus in accordance with claim 18 wherein said page retaining means further includes a strip mounted on each of said walls and having a projecting region for making contact with said pages to maintain alignment therebetween when said pages are in said channel at said loading and said binding positions.

20. Apparatus in accordance with claim 19 wherein said projecting regions of said strips are disposed in facing relationship on opposite sides of said pages at said loading and binding positions.

21. Apparatus in accordance with claim 1 wherein said binding means includes a U-shaped channel having a front wall, a rear wall, a bottom wall with said glue member thereon, and supporting means for holding said pages between said front and rear walls and in contact with said glue member during said binding cycle.

22. Apparatus in accordance with claim 21 wherein said supporting means includes a pair of removable upstanding plates associated with each of said walls, each of said plates having a main body portion and an inner resilient gripping portion attached to and bifurcated from said main body portion to define a gripping space therebetween, said plates being placed on said walls with said walls secured in respective ones of said gripping spaces during said binding cycle.

23. Apparatus in accordance with claim 21 wherein said supporting means comprises adhesive means on the inner surfaces of each of said front and rear walls.

24. Apparatus for affixing a plurality of loose pages into bound form comprising binding means for receiving said pages in cooperation with a glue member thereon, a chassis having an upper carriage means movable between a loading position loosely accommodating said binding means with said pages therein and a binding position to retain said binding means with said pages therein, heating assembly means mounted on said chassis and substantially underlying said carriage means in said binding position for providing heat to said binding means during a binding cycle to melt said glue member, timing means for controlling the application of heat from said heating assembly to said binding means and indicating means for signaling the conclusion of said binding cycle, wherein said binding means includes a front cover portion, a rear cover portion and a spine portion between said cover portions, said glue member being affixed to said spine portion, and page retaining means disposed on each of said cover portions for holding said pages in substantial alignment with each other when said front and rear cover portions are brought towards each other at said loading and said binding positions.

25. Apparatus in accordance with claim 24 wherein said page retaining means includes a strip substantially parallel to said spine portion and having a projecting region for making contact with said pages as said cover portions are brought towards each other to thereby maintain said pages in aligned condition for binding together.

26. Apparatus in accordance with claim 25 wherein said strip has a substantially triangular cross-section and said projecting region comprises the apex of said cross-section, whereby the apices of said strips are disposed in facing relationship on opposite sides of said plurality of pages at said loading and binding positions.

27. Apparatus in accordance with claim 25 wherein said strip has a substantially semi-circular cross-section and said projecting region comprises the uppermost segment thereof tangential to a plane parallel to the respective one of said cover portions, whereby the segments of said strips are disposed in facing relationship on opposite sides of said plurality of pages at said loading and binding positions.

* * * * *